United States Patent [19]

Hantz-Guibas et al.

[11] 4,441,264

[45] Apr. 10, 1984

[54] DRIVER'S HEEL GUARD

[76] Inventors: Diane Hantz-Guibas; John C. Guibas, both of 164-08 85th Ave., Jamaica, N.Y. 11432

[21] Appl. No.: 360,344

[22] Filed: Mar. 22, 1982

[51] Int. Cl.[3] ..... A43B 13/22; A43B 13/26

[52] U.S. Cl. ..... 36/72 B; 36/72 R

[58] Field of Search ..... 36/72 B, 72 R, 73

[56] References Cited

U.S. PATENT DOCUMENTS

| | | | |
|---|---|---|---|
| 1,841,027 | 1/1932 | Gruber | 36/72 B |
| 1,955,159 | 4/1934 | Winget | 36/72 B |
| 2,109,193 | 2/1938 | Field et al. | 36/72 B |
| 3,095,659 | 7/1963 | McClellan | 36/72 B |
| 3,217,430 | 11/1965 | Novick | 36/72 B |
| 3,851,412 | 12/1974 | Voegele et al. | 36/72 B |

FOREIGN PATENT DOCUMENTS

| | | | |
|---|---|---|---|
| 255395 | 6/1948 | Switzerland | 36/72 B |

*Primary Examiner*—Werner H. Schroeder
*Assistant Examiner*—Steven N. Meyers
*Attorney, Agent, or Firm*—Richard L. Miller

[57] ABSTRACT

A driver's heel guard to prevent scuffing a shoe heel area, including a generally U-shaped, plastic body for clipping around the rear end of a shoe and in one design of the invention including a spring steel clip embedded therein.

3 Claims, 4 Drawing Figures

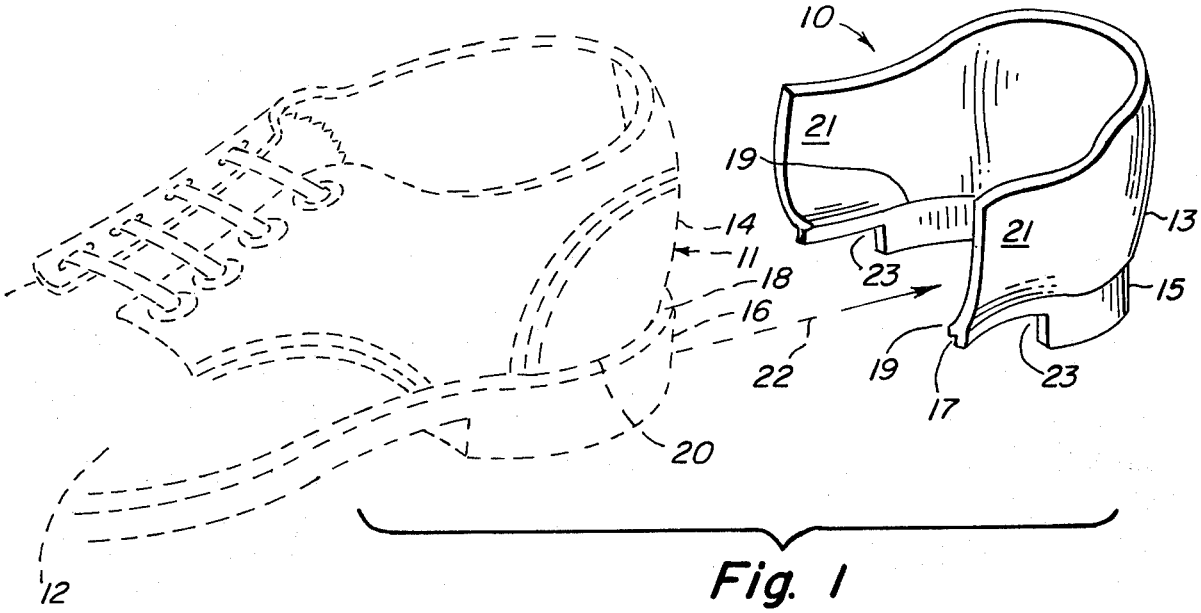
Fig. 1
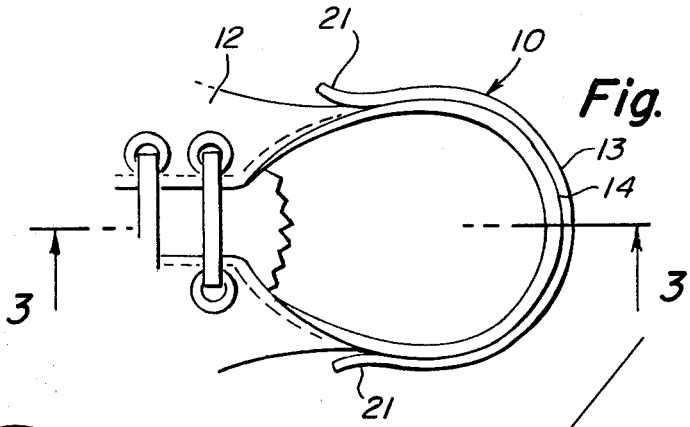
Fig. 2
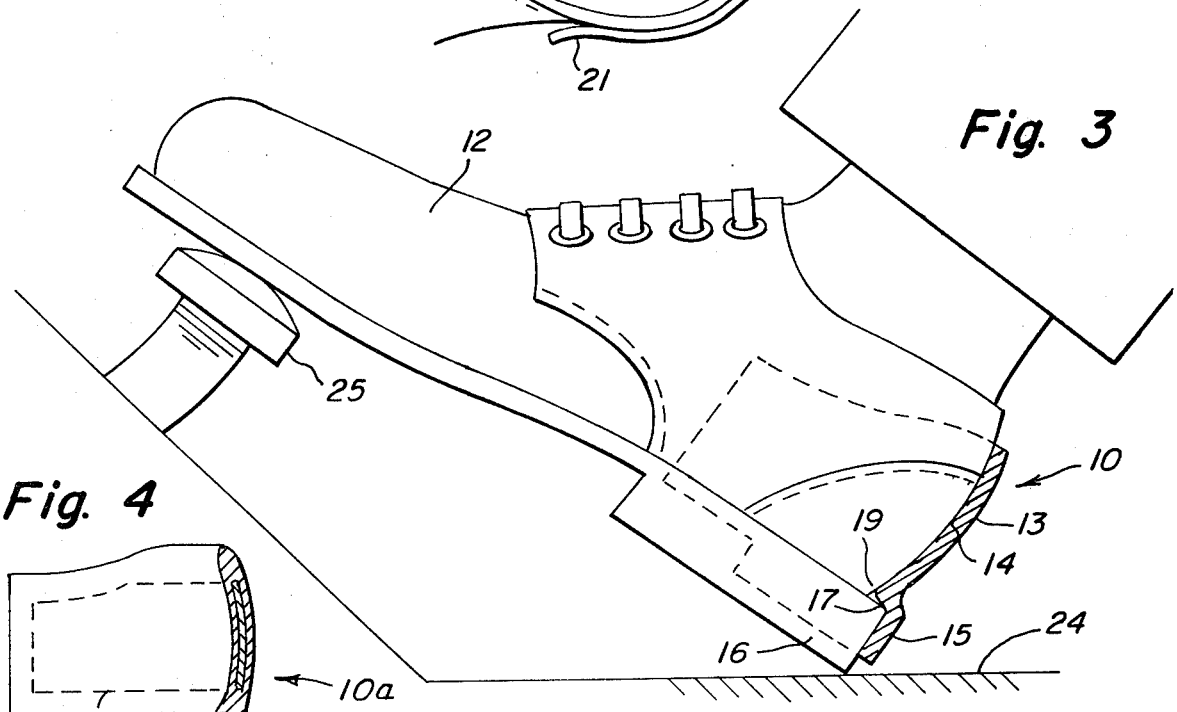
Fig. 3
Fig. 4
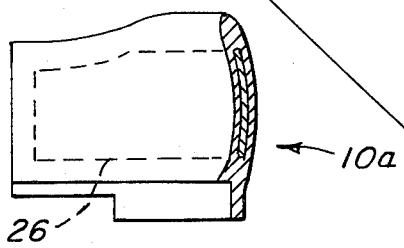

DRIVER'S HEEL GUARD

This invention relates generally to motorist accessories. More specifically it relates to attachments for motorists' shoes.

BACKGROUND OF THE INVENTION

It is well known that often a shoe counter of a motorist becomes scuffed up due to rubbing against the floor of an automobile, while the motorist's foot is angularly tilted respective to the floor, such as when applied on the vehicle accelerator or brake pedals. This foot is usually frequently moved during the travel of the vehicle, in order to change acceleration and braking, so that a continual moving of the foot frictionally rubs the heel and counter of the shoe into any dirt or grit lodged on the floor, thus causing the shoe surface to become scuffed, which visibly damages the shoe appearance. This situation is objectionable and is therefore in need of an improvement.

SUMMARY OF THE INVENTION

Accordingly it is a principal object of the present invention to provide a shield that wraps around the rear end of a shoe so as to prevent it from rubbing and scraping against the floor when the forward end of the shoe is angularly raised.

Another object is to provide a driver's heel guard which in no way interferes with the normal functioning of a foot when operating vehicle foot pedals and which can be quickly and easily snapped on or off of a shoe, as well as being small so that when not in use it can be conveniently stored away in a vehicle glove compartment or any other storage place, if desired.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures on the drawings are briefly described as follows:

FIG. 1 is a front perspective view of the invention in position for being fitted on a shoe.

FIG. 2 is a top view thereof shown installed on a shoe.

FIG. 3 is a side cross sectional view of the invention, taken on line 3—3 of FIG. 2 and shown in use while the driver's foot is on an automobile accelerator or brake pedal.

FIG. 4 is a cross sectional view similar to FIG. 3, showing a modified design of the invention in which a leaf spring is embedded within the device.

DETAILED DESCRIPTION OF A PREFERRED EMBODIMENT

Referring now to the drawing in greater detail and more particularly to FIGS. 1, 2, and 3 thereof at this time, the reference numeral 10 represents a driver's heel guard according to the present invention, for being installed around the rear end 11, of a shoe 12.

The device comprises a single part that is preferably molded of a semi-rigid plastic, in order to be smooth and specifically shaped to the shoe contour, while being inexpensive for mass production manufacturing.

The device is generally U-shaped in order to clip around the shoe's rear end, and includes a major upper portion 13, that shields the shoe upper counter 14, and a narrow lower portion 15, that shields the shoe heel 16, that is usually made of rubber. A shoulder 17, between the upper and lower portions serves to rest against a peripheral top surface 18, of the heel. The shoulder is formed along an inward bead 19, into a recess 20, of the shoe formed by the inwardly rounded lower end of the counter 14. This bead thus serves to prevent the device 10, from slipping upwardly or downwardly on the shoe.

The forwardly projecting opposite ends 21, of the device flare slightly outwardly in order to easily insert the shoe there between when the shoe is moved in the direction indicated by the arrow 22.

As shown, a notch 23, is made at a lower forward corner of the lower portion 15, in order to match a shorter length of shoe heel.

In operative use, it is now evident that the device shields the rear end of the shoe from rubbing against the floor 24, when the shoe forward end is raised to operate a foot pedal 25, of an automobile.

The device 10*a*, shown in FIG. 4, is the same as device 10, except that a spring steel clip 26, is embedded inside the device so as to retain a clipping force from wearing out.

In this design, the plastic body of the device may be made of left and right separate members abutted together along their rear edges so to more readily pivot into opened position on the spring clip 26, embedded therein.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A driver's heel guard comprising, in combination a generally U-shaped body portion for clipping around a rear end of a shoe, a depending U-shaped skirt portion for shielding the shoe heel, the guard having an open bottom, an inwardly directed bead formed on the inner surface intermediate between said body portion and said skirt portion, a shoulder formed under said bead for locking onto a peripheral top surface of the heel of the shoe with the bead fitting into a recess of the shoe between the rear end of the shoe and the shoe heel, the distal ends of said skirt portion being notched so as to terminate in spaced relation prior to the distal ends of said body portion and said bead and shoulder, the distal ends of said body portion being outwardly flared, said body portion, skirt portion, bead and shoulder being molded of a semi-rigid plastic material and a spring steel clip being embedded inside the body portion above said head.

2. A driver's heel guard as in claim 1 wherein said guard is molded as a single unitary piece.

3. A driver's heel guard as in claim 1 wherein said guard is molded in two opposing sections abutted together along their rear edges as to facilitate pivoting the guard into an open position.

* * * * *